United States Patent [19]

Sylvester

[11] 4,289,840

[45] Sep. 15, 1981

[54] INSTANT PROCESSING SLEEVE FOR BORDERLESS PRINTS

[75] Inventor: Robert A. Sylvester, Hilton, N.Y.

[73] Assignee: Eastman Kodak Company, Rochester, N.Y.

[21] Appl. No.: 140,024

[22] Filed: Apr. 14, 1980

[51] Int. Cl.[3] ..... G03C 1/48

[52] U.S. Cl. ..... 430/207; 430/210; 430/256; 430/259; 430/497; 430/499

[58] Field of Search ..... 430/207, 210, 497, 499, 430/259, 256

[56] References Cited

U.S. PATENT DOCUMENTS

| | | | |
|---|---|---|---|
| 3,325,642 | 6/1967 | Emerson | 430/207 |
| 3,586,501 | 6/1971 | Norquist et al. | 430/207 |
| 3,802,887 | 4/1974 | Sorli | 430/207 |

*Primary Examiner*—Charles L. Bowers, Jr.
*Attorney, Agent, or Firm*—J. B. Turner

[57] ABSTRACT

A photographic processing sleeve is provided for receiving and processing a dye donating instant film sheet to produce borderless photographic prints. The sleeve is constructed of first and second sheets coupled together to form a pocket therebetween for receiving the film sheet. One of the sheets includes a central section which carries materials for immobilizing the dyes donated by the film sheet to form a visible picture in the central section. A stripping sheet forms an outermost surface of one face of the sleeve and releasably couples the central section of the first sheet to the remainder of the sleeve so the stripping sheet and the picture in the central section can be stripped away from the remainder of the sleeve.

8 Claims, 6 Drawing Figures

INSTANT PROCESSING SLEEVE FOR BORDERLESS PRINTS

CROSS REFERENCE TO RELATED APPLICATIONS

Reference is made to commonly assigned copending U.S. patent application Ser. No. 140,072, entitled INSTANT PROCESSING SLEEVE, filed in the name of P. D. Bechle et al on Apr. 14, 1980.

BACKGROUND OF THE INVENTION

The present invention relates to self-processing photographic film units, also called instant film units. More specifically, the invention relates to a processing sleeve for use with a dye-donating film sheet to provide borderless photographic prints.

Typically, instant film is processed by covering the film sheet with a second sheet and distributing a viscous processing fluid therebetween. The fluid permeates the photosensitive layers of the film sheet and initiates development of the latent image. Development, in turn, controls diffusion of an imagewise distribution of materials, such as dyes, which transfer to an image-receiving layer where they form the visible picture.

Instant film units having the above general characteristics are well known in many different formats. Those of most interest are referred to as "peel-apart" film units, because the image-receiving layer is in the second sheet, called the image-receiving sheet, and that sheet is peeled apart from the remainder of the film unit after processing. The finished picture is supported in the image-receiving sheet, and the remainder of the film unit is discarded.

In accordance with one type of peel-apart film unit, adapted to be handled as an individual film unit, rather than in a multi-unit pack, a processing sleeve is provided to protect the film sheet prior to the intended exposure and to hold the film sheet and image-receiving sheet in superposition during processing. The film sheet is removed from the sleeve for exposure and returned for processing. After processing, the sleeve is torn open and the image-receiving sheet is peeled away from the film sheet in the usual manner for peel-apart film units.

U.S. Pat. No. 3,586,501, issued in the name of W. E. Norquist on June 22, 1971, depicts an example of a film unit of this type, including an opaque sleeve which carries the image-receiving sheet, a pouch for supplying the processing fluid, side rails for spacing the film and image-receiving sheets apart to control the depth of the distributed processing fluid and a mask for framing the final picture. The opaque sleeve acts as a miniature dark room that contains the film sheet and protects it from fogging. In use: (1) the entire film unit, i.e., the sleeve with the film sheet inside, is loaded into a camera; (2) the film sheet is held by the camera while the sleeve is withdrawn through a light-locked exit slot to uncover the film sheet for exposure; (3) the film sheet is exposed; (4) the sleeve is returned to its position in the camera covering the film sheet; and (5) the entire film unit is transported from the camera through a pair of opposed pressure rollers. The roller pressure ruptures the pouch, distributes the processing fluid, and initiates processing of the film sheet. After a suitable period for development and dye transfer, the sleeve is torn open, the image-receiving sheet is peeled away to provide the finished picture, and the remainder of the film unit is discarded.

A more recently developed processing sleeve, described in the cross-referenced patent application, includes a film retaining sheet doubled over along its lateral edges and coupled to the image-receiving sheet to form a pocket. The film sheet, after it is exposed, is inserted into the pocket in registration with the image-receiving sheet. The image-receiving sheet forms an outermost portion of one face of the sleeve and is directly accessible so that, after processing, it can be stripped from the remainder of the sleeve to provide the final picture.

Although previously known processing sleeves have been satisfactory for their intended purpose, most include a relatively large number of parts, are undesirably complex to manufacture, and are difficult to use. The processing sleeve of the above-mentioned application overcomes many of these disadvantages, but is not particularly conducive to the production of borderless prints.

SUMMARY OF THE INVENTION

In accordance with the present invention, a processing sleeve adapted to receive and process a diffusion transfer instant film sheet, includes an image-receiving section releasably coupled to the remainder of the sleeve by a stripping sheet. The stripping sheet comprises an outermost portion of one face of the sleeve where it is directly accessible to strip the image-receiving section from the remainder of the sleeve through such face. The image-receiving section is then peeled away from the stripping sheet to provide a final print. The sleeve is convenient and versatile in use, is constructed from a relatively small number of elements in a manner convenient to manufacture, and is particularly suitable for the production of borderless prints.

In a preferred embodiment of the invention, the sleeve is constructed of first and second sheets which are coupled together in a manner suitable for receiving the film sheet therebetween. One of the sheets includes a central image-receiving section which immobilizes the material donated by the film sheet to construct the print. The stripping sheet releasably couples this central image-receiving section to a surrounding border so the image-receiving section can be stripped away from the border and the remainder of the sleeve by peeling off the stripping sheet.

In accordance with other features of the invention, the central section has an area that is the same or smaller than the material-donating area of the film sheet to produce a borderless final picture.

Still other aspects of the invention, and more specific features, will become apparent to those skilled in the art from the following detailed description of the preferred embodiment considered together with the accompanying drawings.

BRIEF DESCRIPTION OF THE DRAWINGS

Reference is made to the accompanying drawings, in which.

DETAILED DESCRIPTION OF PREFERRED EMBODIMENT

Figure 4:
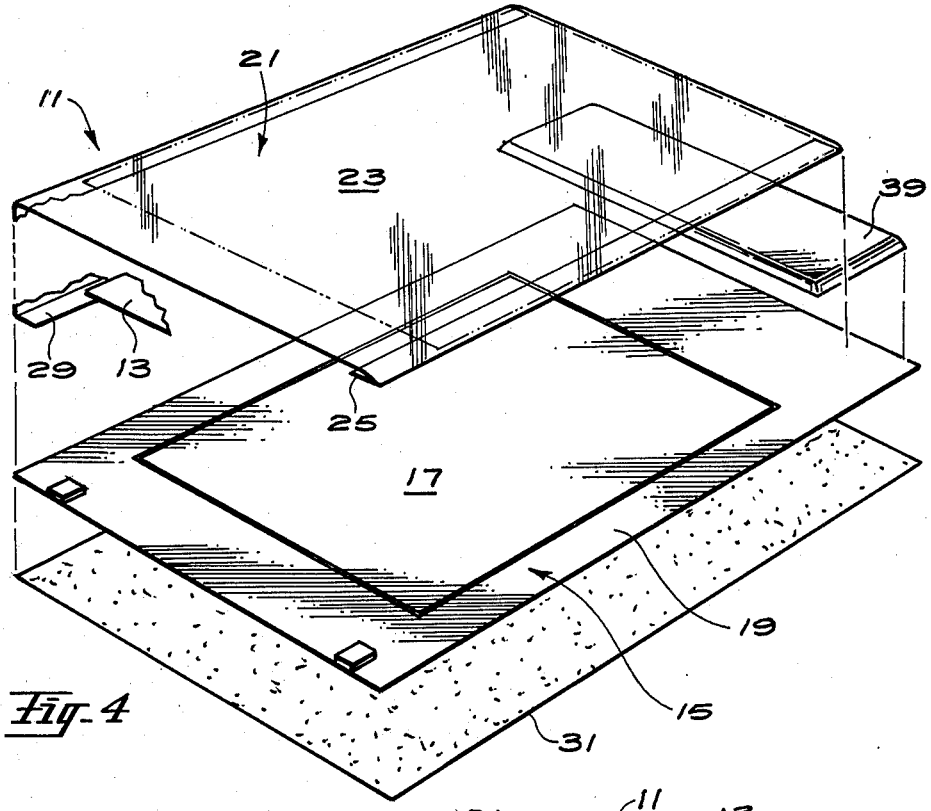
FIG. 4 is an exploded view of the processing sleeve of FIG. 2.
Figure 5:
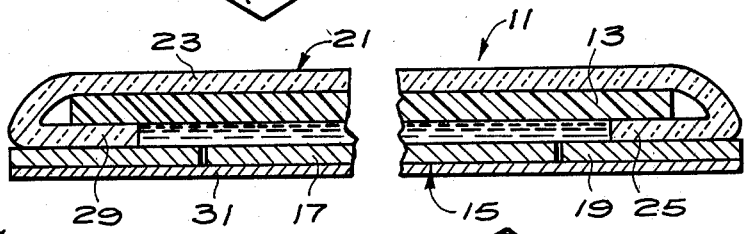
FIG. 5 is a cross-sectional view taken along lines 5—5 in FIG. 3.

Referring now to the accompanying drawings, beginning with FIGS. 4 and 5, a processing sleeve 11, in accordance with a preferred embodiment of the present invention, is depicted for use with a dye-donating instant film sheet 13.

The film sheet is not illustrated in detail, but should be understood to include one or more photosensitive silver halide emulsion layers that record a latent image when exposed to a scene. The exposed sheet is processable by a viscous fluid that initiates development of the latent image and brings about the diffusion transfer of image-forming dyes that are complementary to the light sensitivities of the emulsion layers. The dyes diffuse to a facing surface of the photosensitive, sheet, from which they are transferable to an image-receiving sheet 15 to form a photographic print. A more detailed description of a suitable film sheet and process is contained in copending U.S. patent application Ser. No. 837,778, now U.S. Pat. No. 4,186,004, issued Jan. 29, 1980, entitled PROCESS OF FORMATION OF COLOR IMAGES, PHOTOGRAPHIC PRODUCT AND TREATMENT SOLUTIONS USEFUL FOR PUTTING THE PROCESSING INTO PRACTICE: filed on Sept. 29, 1977 in the name of Jean Dealriges et al.

The image-receiving sheet 15 is adapted to be superposed with the film sheet to receive and immobilize the image-forming dyes from the face of the film sheet. For reasons that will become more apparent from the following description, the image-receiving sheet comprises a central image-receiving section 17, which is separable from a coplanar border 19 that surrounds the central section.

During processing, the film sheet is retained against the image-receiving sheet by a film retaining sheet 21. This sheet includes a generally flat section 23 bounded on opposite edges by folded strips 25 and 29, sometimes called side rails, that are doubled over and permanently attached to the border of the image-receiving sheet. The folded strips define channels which slidably receive the film sheet and guide it into dye-transferring registration with the image-receiving sheet. The strips also establish a space between the film and image-receiving sheets to accommodate processing fluid.

Referring again to the image-receiving sheet, its respective sections are separably coupled together by a thin, flexible stripping sheet 31, which forms an outermost portion of one face of the sleeve opposite the retaining sheet. The stripping sheet includes a strippable adhesive or the like and extends over both the central section and border of the image-receiving sheet to releasably couple them together in a common plane.

The central image-receiving section 17 is approximately the same size or is smaller than the dye-transferring portion of the film sheet to provide a borderless print comprising the central section. Actually, the print that is transferred from the film sheet extends into the border 19 of the image-receiving sheet, but only the central image-receiving section is used as the print. The slit or score line between the central section and the border is covered by the stripping sheet so no processing fluid will escape.

Figure 1:
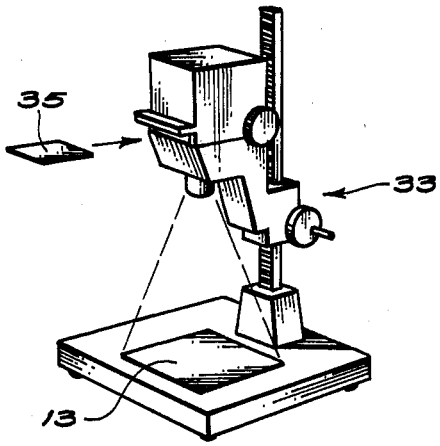
FIG. 1 is a schematic perspective view of a photographic enlarger exposing instant film sheets usable with processing sleeves in accordance with the present invention.
Figure 2:
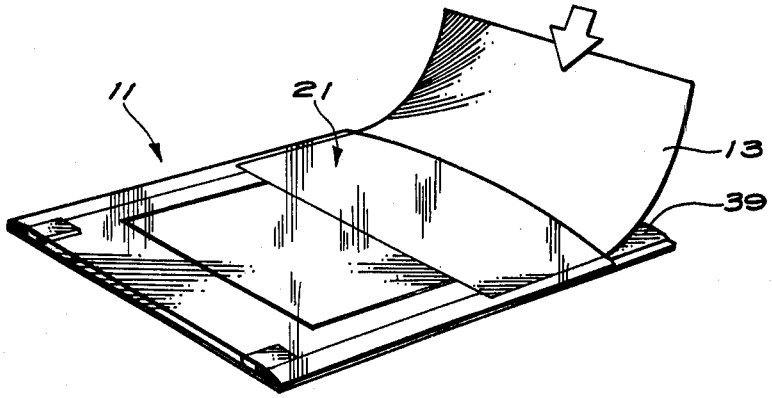
FIG. 2 is a perspective view of a processing sleeve in accordance with a preferred embodiment of the present invention with an instant film sheet partially inserted into the sleeve.
Figure 3:
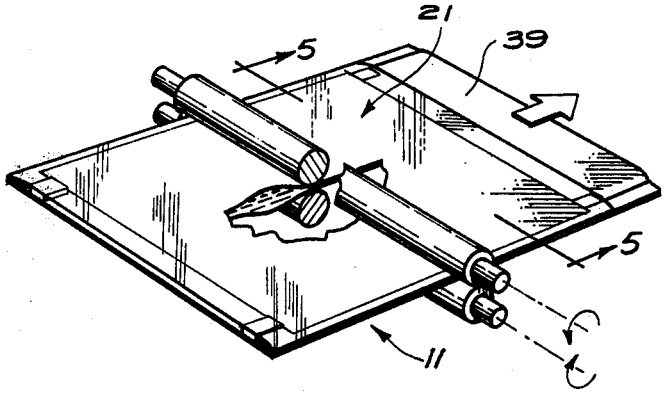
FIG. 3 is a perspective view of the processing sleeve of FIG. 2, and the film sheet, as they are moved between a pair of pressure rollers to initiate processing of the film sheet.

In operation, and as depicted in FIGS. 1–3, the film sheet is exposed in an enlarger 33, for example, by projecting light through a transparent master 35 onto the surface of the film sheet. Of course the exposure would take place under dark conditions to prevent fogging of the film. After the exposure, the film is slidably inserted into the processing sleeve (FIG. 2), and the entire sleeve, with the film sheet inside, is advanced between a pair of pressure rollers (FIG. 3). The pressure rollers initiate processing of the film by rupturing a pouch 39 of processing fluid, which is adhered to the image-receiving sheet at one end thereof, and by distributing the fluid from the pouch between the film sheet and the image-receiving sheet. The strips 25 and 29 (FIG. 5) control the depth of the distributed fluid.

Figure 6:
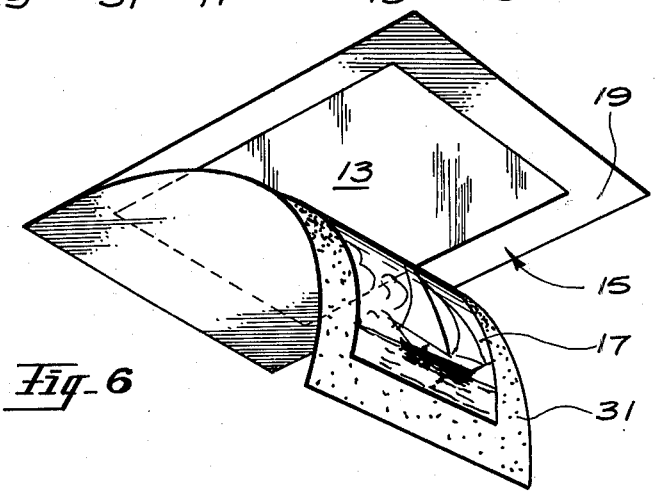
FIG. 6 is a perspective view depicting the removal after processing of the stripping sheet and final picture from the remainder of the processing sleeve.

When dye transfer is completed, the final picture is recovered by peeling the stripping sheet, and with it the central image-receiving portion (see FIG. 6) of the image-receiving sheet, away from the border and the remainder of the sleeve. It should be noted that the stripping sheet, and through it the central image-receiving section, are directly accessible from the outside of the processing sleeve, so there is no need to open the sleeve first to reach the picture. In fact, the entire sleeve is formed by the already mentioned parts, which are significantly reduced in number from processing sleeves previously known in the prior art.

Finally, in order to provide a final picture which is not encumbered by any of the processing materials, the central image-receiving section, which was removed with the stripping sheet, is itself peeled away from the stripping sheet to leave a clean borderless print.

It should now be apparent from the preceeding description that the present invention provides a processing sleeve having important advantages not available from the teaching of the prior art. The structure is relatively simple to manufacture and includes only a small number of separate parts. It is versatile in application and convenient to use, being particularly suited for the production of borderless prints.

Although the invention has been described with particular reference to a preferred embodiment thereof, it will be readily understood that variations and modifications can be effected within the spirit and scope of the invention as described hereinabove and as defined in the appended claims.

I claim:

1. In a processing sleeve including first and second sheets coupled together in a manner suitable for receiving therebetween a diffusion transfer film sheet, the first sheet having an image-receiving section separable from a border section surrounding the image-receiving section, the improvement comprising:

a thin coupling sheet forming an outermost face of said sleeve and adhered to the image-receiving section and the border section, said coupling sheet being separable from said border section to release the image-receiving section from said sleeve, and thereafter being separable from said image-receiving section to provide a borderless picture comprising said image-receiving section.

2. In a processing sleeve for receiving and processing a dye-donating film sheet, and including an image-receiving section separable from the remainder of the sleeve after processing to provide a photographic picture; the improvement comprising:

a stripping sheet forming an outermost portion of one face of said sleeve and releasably coupling said separable image-receiving section to the remainder of said sleeve, said stripping sheet being strippable with said image-receiving section away from the remainder of said sleeve to separate the picture from the remainder of the sleeve, and thereafter being strippable from the image-receiving section to separate the picture from said stripping sheet.

3. The improvement as set forth in claim 2, wherein a coplanar border section surrounds said image-receiving section and said stripping sheet extends over said image-receiving section and said border section to releasably couple said sections.

4. The improvement set forth in claim 3, wherein the film sheet includes a dye-transferring section, and the image-receiving section has an area the same or smaller than the dye-transferring section, whereby a photographic picture produced in the image-receiving section is borderless.

5. In a processing sleeve including first and second sheets coupled together in a manner suitable for receiving therebetween a diffusion transfer film sheet, the first sheet having an image-receiving section separable from the remainder of the sleeve and a border surrounding the image-receiving section, the improvement comprising:

a stripping sheet forming an outermost portion of one face of said sleeve and releasably coupling said separable image-receiving section to the border, said stripping sheet being strippable from the border to separate said image receiving section from the remainder of said sleeve, the image-receiving section thereafter being strippable from said stripping sheet.

6. The improvement set forth in claim 5, wherein the film sheet includes a dye donating section, and the image-receiving section of the image-receiving sheet has an area the same or smaller than the dye donating section of the film sheet, whereby the picture formed in the image-receiving section is borderless.

7. In a processing sleeve for use with a photographic film sheet processable by a fluid to form an imagewise distribution of diffusion transferable material, the sleeve including an image-receiving sheet having a border section and a central section separable from the border section, the central section including means for receiving from the film sheet and for immobilizing the diffusion transferable material to form a visible image in the central section, and a film retaining sheet permanently coupled to the border section of the image-receiving sheet and forming a pocket with the image-receiving sheet for receiving the film sheet in registration with the image-receiving sheet; the improvement comprising:

a stripping sheet forming an outermost face surface of said sleeve and releasably coupled to said central and border sections of said image-receiving sheet for stripping the central section from the remainder of said sleeve.

8. In a processing sleeve for use with a photographic film sheet processable by a fluid to form an imagewise distribution of diffusion transferable material, the sleeve including an image-receiving sheet having a border section and a central section separable from the border section, the central section including means for receiving from the film sheet and for immobilizing the diffusion transferable material to form a visible image in the central section, and a film retaining sheet permanently coupled to the border section of the image-receiving sheet and forming a pocket with the image-receiving sheet for receiving the film sheet in registration with the image-receiving sheet; the improvement comprising:

a cover sheet positioned over the border section and central section of the image-receiving sheet; and an adhesive releasably adhering the cover sheet to said border section and said central section whereby after formation of an image on said central section the cover sheet can be peeled from the border section to separate said central section from said border section and the sleeve and then peeled from said central section to produce a borderless picture comprising said central section.

* * * * *